US008634755B2

(12) United States Patent
Ichikawa et al.

(10) Patent No.: US 8,634,755 B2
(45) Date of Patent: Jan. 21, 2014

(54) CLEANING UNIT, IMAGE CARRIER UNIT, AND IMAGE FORMING APPARATUS

(75) Inventors: Tomoya Ichikawa, Kanagawa (JP); Akiko Kimura, Kanagawa (JP); Yuzo Ichikawa, Kanagawa (JP); Takahiro Shinkawa, Kanagawa (JP); Masaaki Tokunaga, Kanagawa (JP); Tsuneo Fukuzawa, Kanagawa (JP); Hirohisa Hoshino, Kanagawa (JP); Satoshi Honobe, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 238 days.

(21) Appl. No.: 13/036,314

(22) Filed: Feb. 28, 2011

(65) Prior Publication Data

US 2012/0082495 A1 Apr. 5, 2012

(30) Foreign Application Priority Data

Sep. 30, 2010 (JP) ..... 2010-220134

(51) Int. Cl.
*G03G 21/00* (2006.01)

(52) U.S. Cl.
USPC ..... 399/351; 399/123; 15/256.5; 15/256.51

(58) Field of Classification Search
USPC ..... 399/123, 327, 350, 351; 15/256.5, 15/256.51
See application file for complete search history.

(56) References Cited

U.S. PATENT DOCUMENTS 4,152,067 A * 5/1979 Kubota ..... 399/351
5,517,294 A * 5/1996 Ogiri et al. ..... 399/351
6,836,639 B2 * 12/2004 Karakama et al. ..... 399/351
7,062,212 B2 * 6/2006 Naruse et al. ..... 399/350
7,254,356 B2 * 8/2007 Tomine et al. ..... 399/101
7,693,446 B2 * 4/2010 Nakano et al. ..... 399/101
8,306,470 B2 * 11/2012 Akamatsu et al. ..... 399/351
2008/0145093 A1 * 6/2008 Fukuta et al. ..... 399/103

FOREIGN PATENT DOCUMENTS

JP 2003-084637 A 3/2003
JP 2009-294355 A 12/2009

OTHER PUBLICATIONS

"Spring Washers: Descriptions & Design Considerations." http://www.wclco.com/Spring_Washers/Descriptions.php. Web. Oct. 21, 2007.*

* cited by examiner

*Primary Examiner* — David Gray
*Assistant Examiner* — Carla Therrien
(74) *Attorney, Agent, or Firm* — Sughrue Mion, PLLC

(57) ABSTRACT

A cleaning unit includes: a cleaning member that cleans the surface of the image carrier; a cleaning container that stores developer removed by the cleaning member; a cleaning support that is formed by bending a plate and includes a cleaning-supporting portion supporting the other end portion of the cleaning member and a supported portion angled with respect to the cleaning-supporting portion by bending; a supporting-portion-of-support that includes a facing portion facing the supported portion, is provided at the cleaning container, and supports the cleaning support; a damping member that is disposed between the supported portion and the facing portion, is formed so as to be elastically deformable, and regulates vibration of the cleaning member; and a securing member that secures the cleaning support to the supporting-portion-of-support at a position adjacent to the damping member.

7 Claims, 6 Drawing Sheets

CLEANING UNIT, IMAGE CARRIER UNIT, AND IMAGE FORMING APPARATUS

CROSS REFERENCE TO RELATED APPLICATION

This application is based on and claims priority under 35 U.S.C. 119 from Japanese Patent Application No. 2010-220134 filed on Sep. 30, 2010.

BACKGROUND

Technical Field

The present invention relates to a cleaning unit, an image carrier unit, and an image forming apparatus.

SUMMARY

According to an aspect of the invention, there is provided a cleaning unit including:

a cleaning member that is formed in the shape of a plate having an end portion coming into contact with a surface of an image carrier, and cleans the surface of the image carrier;

a cleaning container that stores developer removed by the cleaning member;

a cleaning support that is formed by bending a plate and includes a cleaning-supporting portion supporting the other end portion of the cleaning member and a supported portion angled with respect to the cleaning-supporting portion by bending;

a supporting-portion-of-support that includes a facing portion facing the supported portion, is provided at the cleaning container, and supports the cleaning support;

a damping member that is disposed between the supported portion and the facing portion, is formed so as to be elastically deformable, and regulates vibration of the cleaning member; and a securing member that secures the cleaning support to the supporting-portion-of-support at a position adjacent to the damping member.

BRIEF DESCRIPTION OF THE DRAWINGS

Exemplary embodiments of the present invention will be described in detail based on the following figures, wherein.

DETAILED DESCRIPTION

Figure 1:
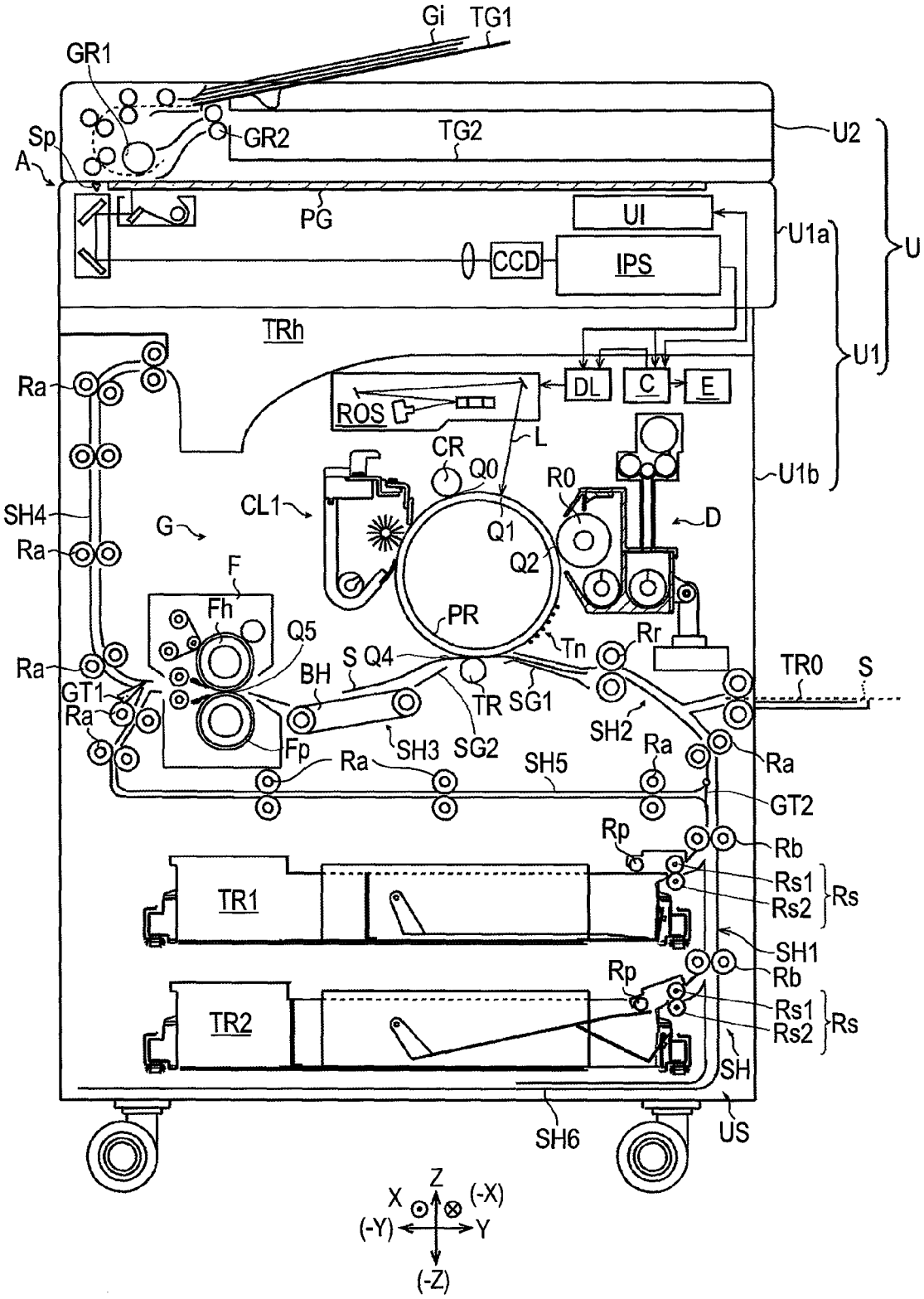
FIG. 1 is a view showing the entire configuration of an image forming apparatus according to Example 1 of the invention.

A specific example (hereinafter, referred to as an example) of an exemplary embodiment of the invention will be described below with reference to the drawings, but the invention is not limited to the following example.

Meanwhile, in order to facilitate the understanding of the following description, in the drawings, the front-and-rear direction is defined as the X-axis direction, the left-and-right direction is defined as the Y-axis direction, and the up-and-down direction is defined as the Z-axis direction. Further, directions or sides indicated by arrows X, −X, Y, −Y, Z, and −Z are defined as the front direction, the rear direction, the right direction, the left direction, the upward direction, and the downward direction, or are defined as the front side, the rear side, the right side, the left side, the upper side, and the lower side, respectively.

Furthermore, in the drawings, a symbol in which "●" exists in "○" means an arrow that is directed to the front of a sheet from the back thereof, and a symbol in which "X" exists in "○" means an arrow that is directed to the back of the sheet from the front thereof.

Meanwhile, other members except for members, which are required for the description, are appropriately omitted in the description using the following drawings in order to facilitate the understanding of the following description.

Example 1

FIG. 1 is a cross-sectional view showing the entire configuration of an image forming apparatus according to Example 1 of the invention.

In FIG. 1, an image forming apparatus U includes a main body U1 of a digital copying machine and a document conveying device U2. The main body U1 serves as an example of a main body of an image forming apparatus that includes a transparent document table PG, that is, a platen glass PG on the upper surface thereof. The document conveying device U2 is supported on the platen glass PG.

The document conveying device U2 includes a document feed tray TG1 serving as an example of a document feed unit in which plural documents Gi to be copied are received while being stacked. The respective plural documents Gi stacked on the document feed tray TG1 sequentially pass through a copying position on the platen glass PG, that is, a contact position of a platen roller GR1 serving as an example of a document conveying member, and are discharged to a document discharge tray TG2 serving as an example of a document discharge unit by a document discharge member GR2.

The main body U1 of the copying machine includes a scanner unit U1*a* serving as an example of an image reading unit including the platen glass PG, and a printer section U1*b* serving as an example of an image recording unit.

The scanner unit U1*a* includes a position detecting member of an exposure system disposed at a reading reference position, that is, a so-called exposure-system registration sensor Sp, and an exposure optical system A.

The movement and stopping of the exposure optical system A are controlled by a detection signal of the exposure-system registration sensor Sp, and the exposure optical system is normally stopped at the reading reference position shown in FIG. 1.

In the case of an automatic conveying operation where the document conveying device U2 makes a copy, the exposure optical system A exposes the respective documents Gi sequentially passing through the copying position on the platen glass PG while being stopped at the reading reference position.

In the case of a manual reading operation where an operator places a document Gi on the platen glass PG by hand to make a copy, the exposure optical system A exposes and scans the document Gi placed on the platen glass PG while being moved to the right side.

Light reflected from the exposed document Gi passes through the exposure optical system A and is converged on an imaging part CCD. The imaging part CCD converts the light, which is reflected from the document and converged on an imaging surface of the imaging part CCD, into an electrical signal.

An image processing part IPS converts a read image signal, which is input from the imaging part CCD, into a digital image writing signal and outputs the digital image writing signal to a writing drive circuit DL of the printer section U1*b*.

The writing drive circuit DL of which operation time is controlled by a controller C of the printer section U1*b* outputs a drive signal, which corresponds to input image data, to a latent image writing unit ROS.

A photoconductor PR serving as an example of an image carrier to be rotated is disposed below the latent image writing unit ROS. After the surface of the photoconductor PR is charged at a charging region Q0 by a charging roller CR serving as an example of a charger, the surface of the photoconductor is exposed and scanned at a latent image writing position Q1 by a laser beam L serving as an example of latent image writing light of the latent image writing unit ROS. Accordingly, an electrostatic latent image is formed on the surface of the photoconductor PR. The surface of the photoconductor PR on which the electrostatic latent image is formed is rotated and moved and sequentially passes through a developing region Q2 and a transfer region Q4.

A developing device D, which develops the electrostatic latent image at the developing region Q2, conveys developer to the developing region Q2 by a developing roller R0 serving as an example of a developing unit, and develops the electrostatic latent image, which is formed on the surface of the photoconductor PR and passes through the developing region Q2, into a toner image Tn serving as an example of a visible image.

A transfer roller TR, which serves as an example of a transfer unit and faces the photoconductor PR at the transfer region Q4, is a member for transferring the toner image Tn, which is formed on the surface of the photoconductor PR, to a sheet S that serves as an example of a body to which an image is to be transferred and an example of a medium. A transfer voltage having a polarity opposite to the charging polarity of the developing toner used in the developing device D is supplied to the transfer roller TR from a power circuit E. Applied voltages, such as a charging voltage applied to the charging roller CR, a developing voltage applied to the developing roller R0, and a transfer voltage applied to the transfer roller TR; the power circuit E that includes a heater power source for heating a heater of a heating roller of a fixing device F to be described below; and the like are controlled by the controller C.

First and second sheet feed trays TR1 and TR2 serving as an example of a sheet feed container are vertically disposed in a line at a lower portion of the main body U1 of the copying machine.

A pick-up roller Rp, which serves as an example of a member for taking a medium out, is disposed at an upper right end portion of each of the sheet feed trays TR1 and TR2. Sheets S taken out by the pick-up roller Rp are conveyed to a separating member Rs.

The separating member Rs includes a feed roller Rs1 serving as an example of a sheet feed member and a retard roller Rs2 serving as an example of a separation member. The feed roller Rs1 and the retard roller Rs2 come into contact with each other. Sheets conveyed to the separating member Rs are separated one by one, and are conveyed to a sheet conveying path SH1 serving as an example of a medium conveying path.

Conveying rollers Rb serving as an example of a conveying member, which can be rotated in a normal direction and a reverse direction, are disposed on the sheet conveying path SH1. The sheet S conveyed to the sheet conveying path SH1 is conveyed to a sheet conveying path SH2 before transfer, which is provided on the upper side, by the conveying roller Rb that can be rotated in the normal direction and the reverse direction.

The sheet S, which is conveyed to the sheet conveying path SH2 before transfer, is conveyed to a registration roller Rr, which serves as an example of a member for adjusting the time when a sheet is conveyed to the transfer region Q4, by conveying rollers Ra.

Further, a sheet S, which is fed from a manual feed tray TR0 serving as an example of a manual section, is also conveyed to the registration roller Rr.

The sheet S conveyed to the registration roller Rr is guided to a sheet guide SG1 before transfer, which serves as an example of a medium guide member before transfer, in accordance with the time when the toner image Tn formed on the surface of the photoconductor PR is moved to the transfer region Q4, and is conveyed to the transfer region Q4.

The toner image Tn, which is developed on the surface of the photoconductor PR, is transferred to a sheet S at the transfer region Q4 by the transfer roller TR. After transfer, the surface of the photoconductor PR is cleaned by a cleaner CL1 serving as an example of a cleaning unit, so that residual toner serving as an example of a deposit is removed. Then, the surface of the photoconductor is charged again by the charging roller CR.

The photoconductor PR, the charging roller CR, the latent image writing unit ROS, the developing device D, and the like form a toner image forming device G serving as an example of a visible image forming device. Further, in Example 1, the photoconductor PR and the cleaner CL1 form an image carrier unit PR+CL1, that is, a so-called process cartridge that can be replaced and integrally attached to/detached from the image forming apparatus U.

A sheet conveying path SH3 after transfer is provided on the downstream side of the transfer region Q4 in a sheet conveying direction. The sheet conveying path SH3 after transfer serves as an example of a conveying path along which a sheet S to which the toner image Tn has been transferred at the transfer region Q4 is conveyed to a fixing region Q5. The sheet S to which the toner image has been transferred at the transfer region Q4 by the transfer roller TR is separated from the surface of the photoconductor PR, is guided by a sheet guide SG2 that serves as an example of a medium guide member after transfer disposed on the sheet conveying path SH3 after transfer, and is conveyed to a fixing device F by a conveying belt BH serving as an example of a medium conveying member after transfer.

The fixing device F includes a heating roller Fh and a pressing roller Fp. The heating roller Fh serves as an example of a heating-fixing member that includes a heater as a heat source therein. The pressing roller Fp serves as an example of a pressing-fixing member. When the sheet S conveyed to the fixing device F passes through the fixing region Q5 formed of a contact region between the heating roller Fh and the pressing roller Fp, the toner image is heated and fixed. Then, the sheet S conveyed to the fixing device F is conveyed to an ejection tray TRh, which serves as an example of a medium ejection section, through a sheet ejection path SH4 serving as an example of a conveying path.

A switching gate GT1, which serves as an example of a member for switching a conveying path, is disposed on the downstream side of the fixing device F on the sheet ejection path SH4. The switching gate GT1 switches the conveying direction of a sheet S, which has passed through the fixing device F, to a direction corresponding to the ejection tray TRh or a connection path SH5. The connection path SH5 connects the sheet conveying path SH1 with an upstream end of the sheet ejection path SH4, that is, a downstream portion of the fixing device F.

In the case of double-sided copying, a sheet S of which one side has a recorded first toner image is conveyed to the connection path SH5 by the switching gate GT1, and is conveyed to a reversing path SH6, which serves as an example of a conveying path, through a gate GT2, which serves as an example of a member for regulating the conveying direction, by the reverse rotation of the conveying rollers Rb that can be rotated in the normal direction and the reverse direction. The sheet S conveyed to the reversing path SH6 is conveyed in the reverse direction by the normal rotation of the conveying rollers Rb that can be rotated in the normal direction and the reverse direction. That is, the sheet S conveyed to the reversing path SH6 is switched back and conveyed to the transfer region Q4 again while the surface and back surface of the sheet are reversed.

Elements denoted by the reference numerals SH1 to SH6 form a conveying path SH that serves as an example of a medium conveying path.

The conveying path SH, the rollers Ra, Rb, and Rr that are disposed on the conveying path SH and have a function of conveying a sheet, and the like form a sheet conveying device US that serves as an example of a medium conveying device.

(Description of Cleaning Unit)

Figure 2:
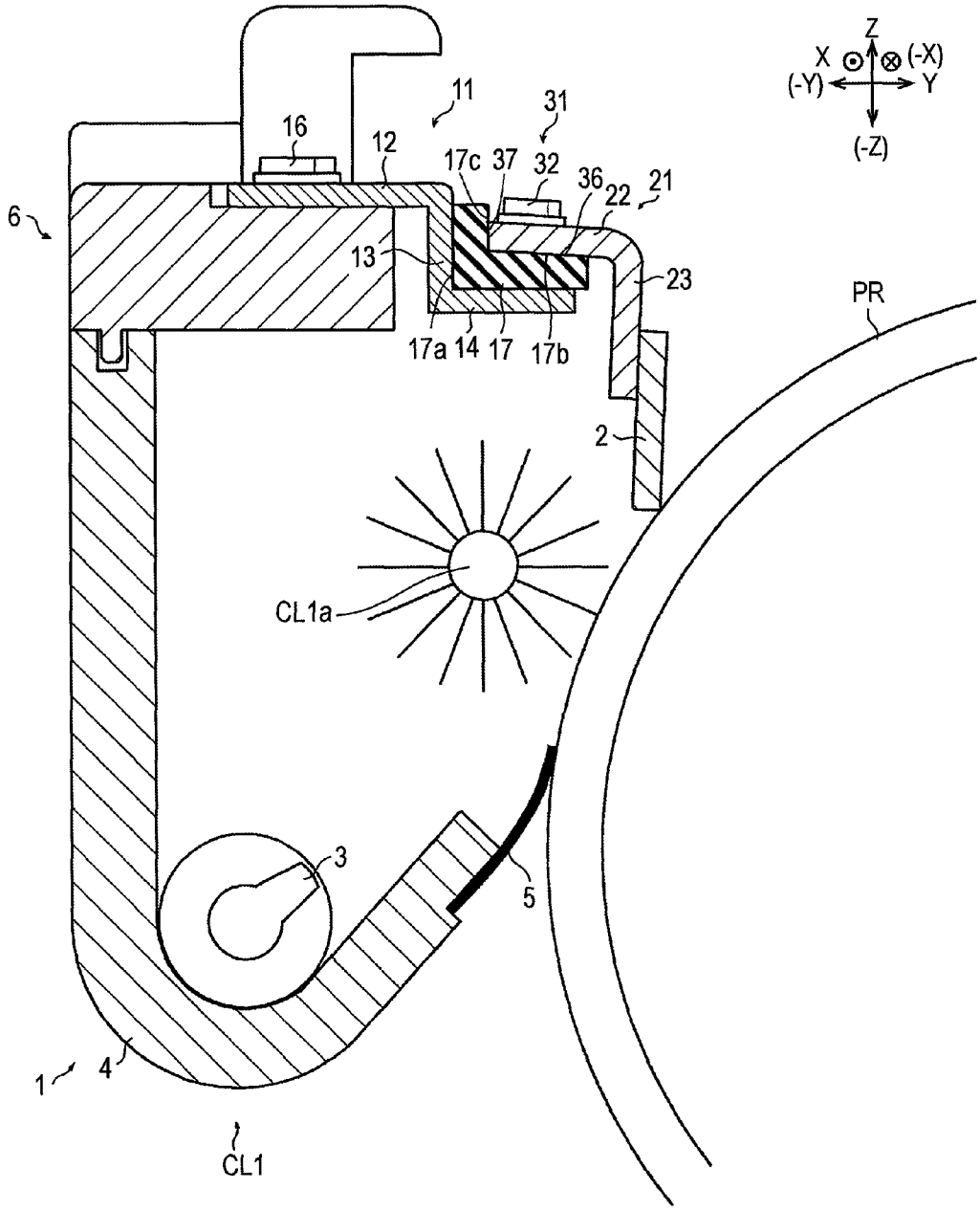
FIG. 2 is an enlarged view of main parts of a cleaning unit of Example 1 of the invention.

FIG. 2 is an enlarged view of main parts of the cleaning unit of Example 1 of the invention.

Figure 3:
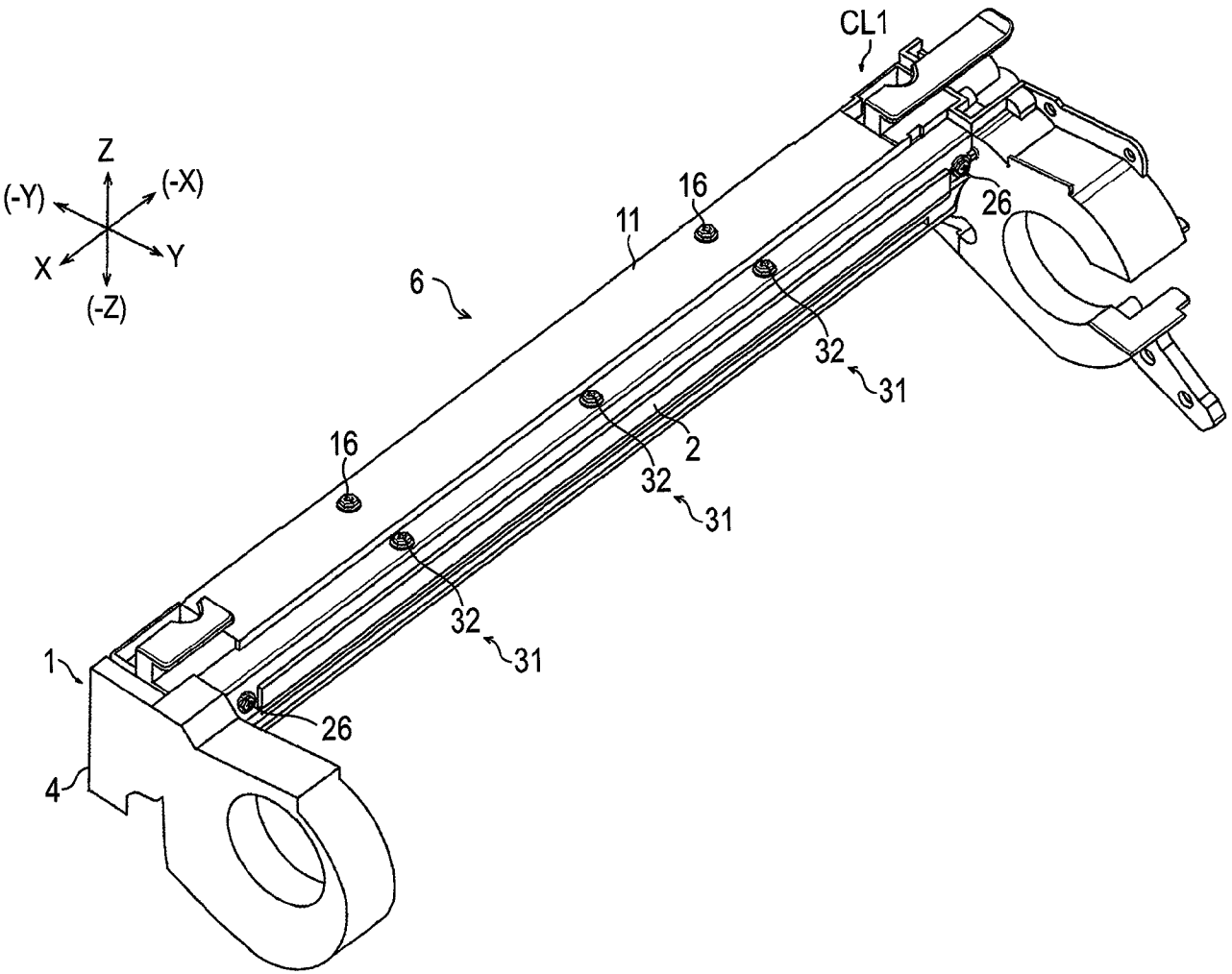
FIG. 3 is a perspective view showing that an image carrier is removed from an image carrier unit of Example 1.

FIG. 3 is a perspective view showing that the image carrier is removed from the image carrier unit of Example 1.

In FIGS. 1 to 3, the cleaner CL1 of Example 1 of the invention includes a cleaning container 1, a cleaning blade 2 serving as an example of a cleaning member, and a cleaning brush CL1*a* serving as an example of a second cleaning member. The cleaning blade 2 is disposed in the cleaning container 1, and comes into contact with the surface of the photoconductor PR so as to scrape residual toner, which remains on the surface of the photoconductor PR, off. The cleaning brush CL1*a* comes into contact with the surface of the photoconductor PR on the upstream side of the cleaning blade 2 in the rotational direction of the photoconductor PR. Accordingly, the residual toner, which is scraped off by the cleaning blade 2 and the cleaning brush CL1*a*, is recovered to the cleaning container 1. A conveying member 3 is disposed in the cleaning container 1. The conveying member 3 conveys the residual toner, which is recovered to the cleaning container 1, to a waste toner recovery container.

The cleaning container 1 includes a cleaning container main body 4 that extends along the photoconductor PR in the front-and-rear direction.

Figure 4:
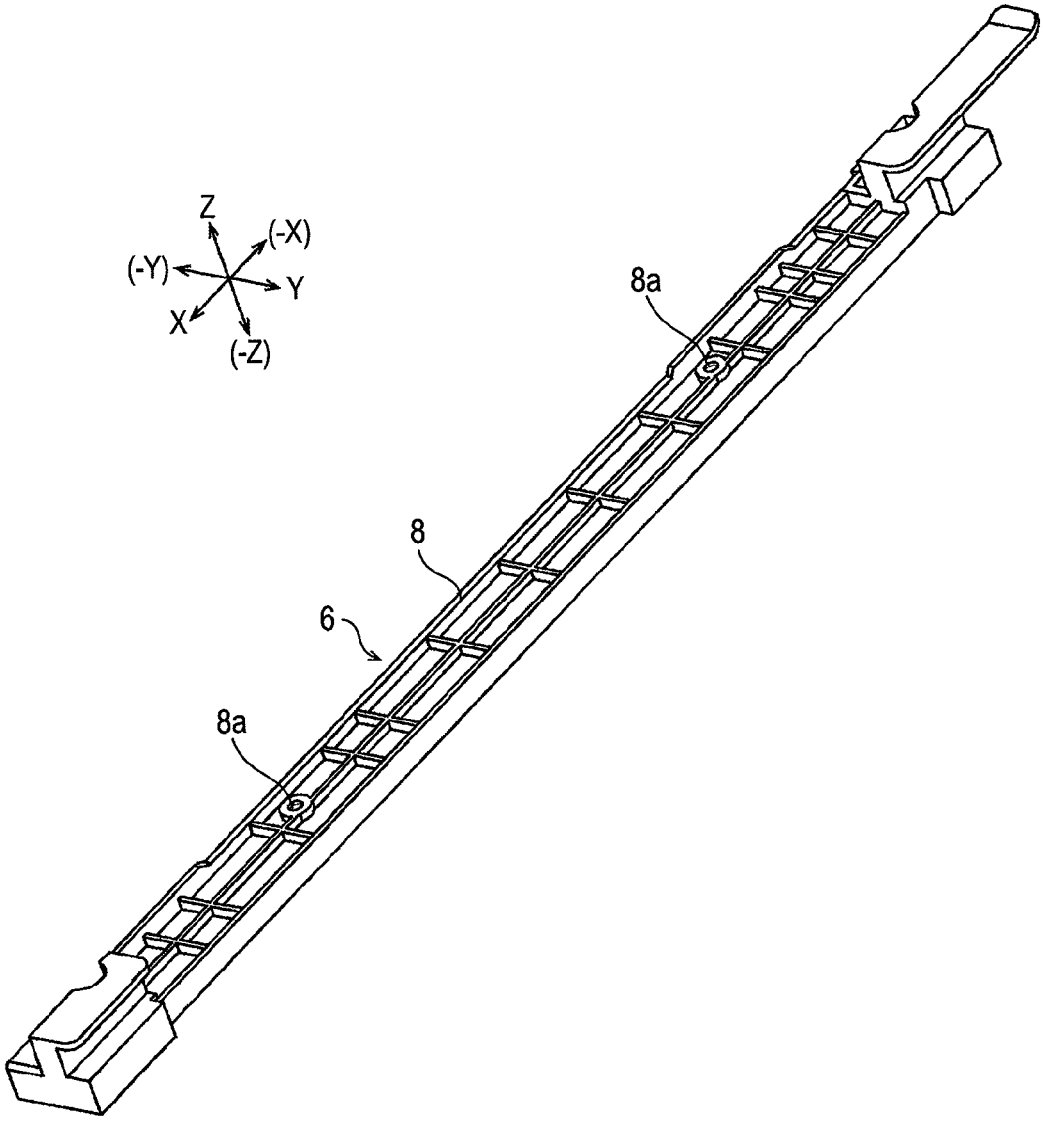
FIG. 4 is a perspective view of a sheet-metal fixing section of Example 1.

FIG. 4 is a perspective view of a sheet-metal fixing section of Example 1.

A film seal 5 serving as an example of a leakage preventing member is fixedly supported at a lower portion of a cleaning container main body 4 that faces the photoconductor PR. The film seal 5 extends toward the surface of the photoconductor PR. An upper end portion of the film seal 5 comes into contact with the surface of the photoconductor PR, so that the film seal 5 prevents residual toner from leaking from the cleaning container 1 to the outside.

In FIG. 2, a sheet-metal fixing section 6 is supported at an upper end of the cleaning container main body 4.

In FIG. 4, the sheet-metal fixing section 6 includes a fixing section main body 8 that extends in the front-and-rear direction. Two screw holes 8*a* of the fixing section are formed at both front and rear portions of the upper surface of the fixing section main body 8.

Figure 5:
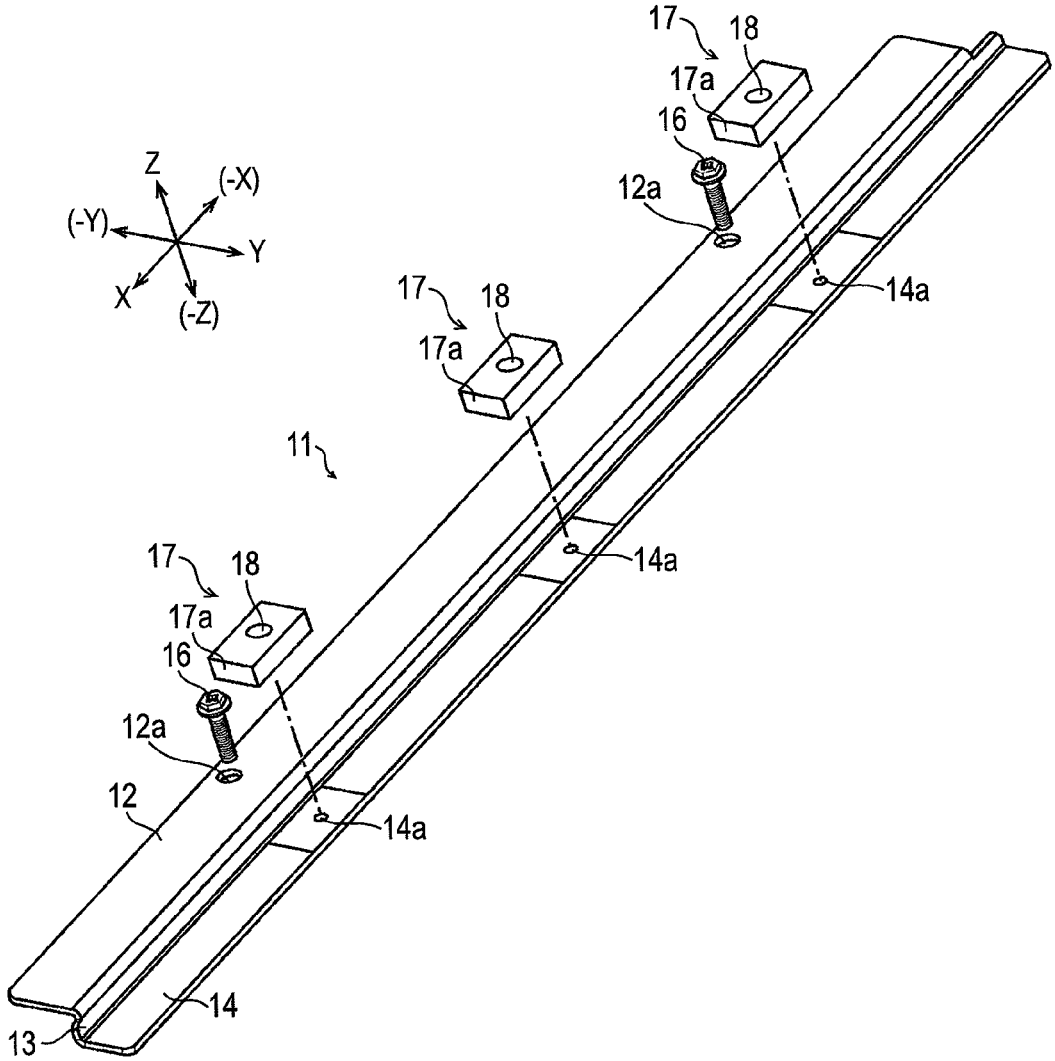
FIG. 5 is a perspective view showing that damping members are removed from a supporting portion of a support of Example 1.

FIG. 5 is a perspective view showing that damping members are removed from a supporting portion of a support of Example 1.

In FIGS. 2, 3, and 5, a fixing metal plate 11, which serves as a supporting portion of a support, is supported on the upper surface of the sheet-metal fixing section 6. The fixing metal plate 11 of Example 1 is formed by bending a metal plate, which extends along the photoconductor PR in the front-and-rear direction, in the shape of a crank. The fixing metal plate 11 includes a fixed section 12 serving as an example of a second bent portion, a connecting portion 13 serving as an example of a first bent portion, and a facing portion 14. The fixed section 12 is supported on the upper surface of the fixing section main body 8. The connecting portion 13 is bent downward from the right end of the fixed section 12. The facing portion 14 is bent to the right side from the lower end of the connecting portion 13.

Round fixed holes 12*a* are formed on the upper surface of the fixed section 12 at positions corresponding to the two screw holes 8*a*, and the fixing metal plate 11 is fixed to the sheet-metal fixing section 6 by first fastening screws 16 that pass through the fixed holes 12*a* and are screwed to the screw holes 8*a* of the fixing section. Further, three screw holes 14*a* for damping members, which serve as an example of second openings, are formed at both front and rear portions and a middle portion of the upper surface of the facing portion 14.

In FIGS. 2 and 5, cushion materials 17 serving as an example of damping members are disposed on the upper surface of the facing portion 14 at positions corresponding to the three screw holes 14*a* for the damping members. The cushion material 17 is formed of an elastic member, and is formed in the shape of a rectangle extending in the front-and-rear direction as shown in FIG. 5. Round cushion openings 18, each of which has the shape of a round hole passing through the cushion material 17 in the up-and-down direction at the positions corresponding to the screw holes 14*a* for the damping members, are formed at the cushion materials 17 as an example of openings of the damping members.

Figure 6:
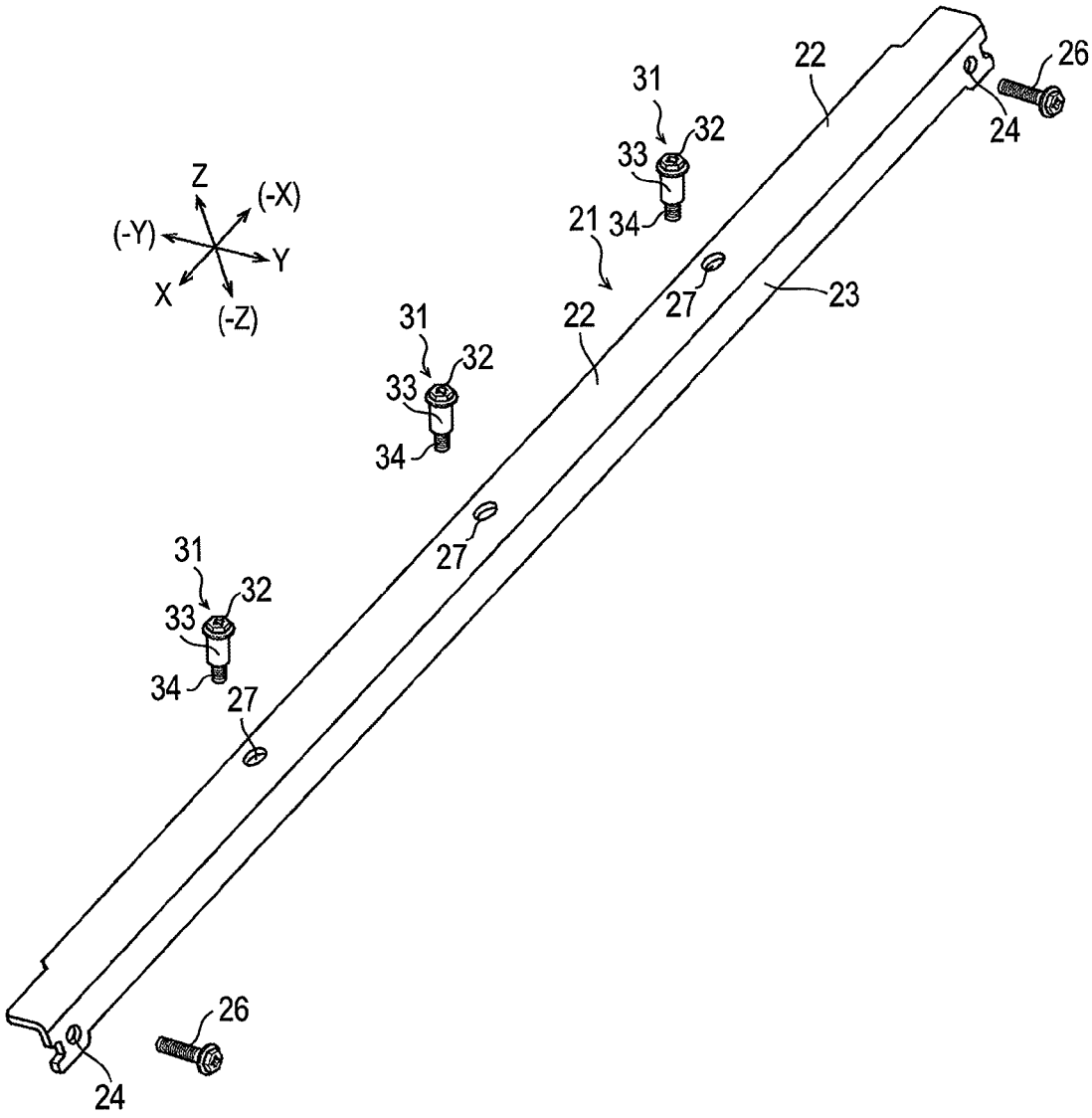
FIG. 6 is a perspective view of a supported portion of Example 1.

FIG. 6 is a perspective view of a supported portion of Example 1.

In FIGS. 2, 3, and 6, a blade metal plate 21 serving as an example of a cleaning support is disposed on the cushion materials 17. The blade metal plate 21 of Example 1 extends along the photoconductor PR in the front-and-rear direction, and is bent in an inverted L shape. The blade metal plate 21 includes a supported portion 22 that corresponds to the cushion materials 17, and a cleaning-supporting portion 23 that is bent downward from the right end of the supported portion 22. Meanwhile, the blade metal plate 21 of Example 1 is made of the same metal material as the material of the fixing metal plate 11, and is formed so that the thickness of the blade metal plate 21 in the up-and-down direction is larger than that of the fixing metal plate 11 in the up-and-down direction. Accordingly, the stiffness of the blade metal plate 21 is higher than that of the fixing metal plate 11.

Further, fastening holes 24 are formed at both front and rear end portions of the cleaning-supporting portion 23.

Three round fixed holes 27 of a blade supporting portion, which serve as an example of first openings, are formed on the upper surface of the supported portion 22 at positions corresponding to the three cushion openings 18. Meanwhile, each of the fixed holes 27 of the blade supporting portion of Example 1 is formed so as to have a diameter larger than the outer diameter of the screw hole 14*a* for the damping member.

In FIGS. 2 and 6, the blade metal plate 21 is fixedly supported on the fixing metal plate 11 by columnar shoulder screws 31 serving as an example of fixing members while the cushion materials 17 are interposed between the blade metal plate 21 and the fixing metal plate 11. A head 32, which has a diameter larger than the diameter of the fixed hole 27 of the blade supporting portion, is formed at one end portion of the shoulder screw 31 as an example of an end portion. A columnar stepped portion 33, of which the outer diameter corresponds to the inner diameters of the cushion opening 18 and the fixed hole 27, is formed at the middle portion of the shoulder screw 31. A columnar screw portion 34 is continuously formed at the other end portion of the shoulder screw 31 as an example of the other end portion. A screw is formed on the outer peripheral surface of the columnar screw portion 34 so as to correspond to the screw hole 14*a* for the damping member.

Meanwhile, the length of the stepped portion 33 of Example 1 in the up-and-down direction is set according to a preset gap between the supported portion 22 and the facing portion 14. The length of the stepped portion 33 in the up-and-down direction is smaller than the thickness of the combination of the supported portion 22 and the cushion material 17 in the up-and-down direction.

Accordingly, when the shoulder screws 31 pass through the cushion openings 18 and the fixed holes 27 of the blade supporting portion from above and the screw portions 34 are fixed to the screw holes 14*a*, the heads 32 come into contact with the upper surface of the supported portion 22 and the supported portion 22 is supported while the gap between the supported portion 22 and the facing portion 14 is set to a gap of the stepped portion 33. Therefore, a lower surface contact portion 36 of the supported portion 22, which serves as an example of a first contact portion, pushes the upper surfaces of the cushion materials 17 and elastically deforms the cushion materials 17.

Here, the length of the cushion material 17 of Example 1 in the left-and-right direction is set so that a left end 17*a* of the cushion material is disposed on the left side of a left side surface 37 of the supported portion 22 serving as an example of a second contact portion while the cushion material 17 of Example 1 is positioned so that the cushion opening 18 corresponds to the fixed hole 27 of the blade supporting portion as shown in FIG. 2. Accordingly, when the blade metal plate 21 is fixed by the shoulder screws 31 and the lower surface contact portion 36 of the supported portion 22 pushes a right portion 17*b* of the upper surface of the cushion material 17 down so that the cushion material 17 is elastically deformed, the cushion material 17 is kept while being elastically deformed so as to have an L shaped cross-section as shown in FIG. 2. At this time, the left side surface 37 of the supported portion 22 comes into contact with a left portion 17*c* of the upper surface of the cushion material 17. Further, in Example 1, the amount of elastic deformation of the cushion material 17 is set and adjusted by the length of the stepped portion 33 in the up-and-down direction.

Furthermore, a base end portion of the cleaning blade 2 is fixedly supported at the lower end portion of the cleaning-supporting portion 23 of the blade metal plate 21. Moreover, the blade metal plate 21 is fixed to the cleaning container main body 4 by second fastening screws 26 that pass through the fastening holes 24.

In Example 1, contact pressure between the cleaning blade 2 and the surface of the photoconductor PR is set by the second fastening screws 26. That is, a biting amount, which is a set value of the amount of bite of the end portion of the cleaning blade 2 (which is not elastically deformed) into the surface of the photoconductor PR, is set by the fixing of the blade metal plate 21 to the cleaning container main body 4.

(Operation of Example 1)

In the cleaner CL1 of the image forming apparatus U according to Example 1 of the invention that has the above-mentioned structure, the end portion of the cleaning blade 2 comes into contact with the surface of the photoconductor PR so as to remove the residual toner remaining on the surface of the photoconductor PR.

When the cleaning blade 2 removes residual toner, a force is applied to the end portion of the cleaning blade 2, which comes into contact with the surface of the photoconductor PR, due to the amount of developer adhering to the surface of the photoconductor PR, the irregularity of the surface of the photoconductor, the eccentricity of the photoconductor PR, or the like. For this reason, the cleaning blade 2 vibrates. If vibration is generated at the cleaning blade 2, the blade metal plate 21 for fixedly supporting the cleaning blade 2 also vibrates. For this reason, noise is generated.

Meanwhile, since the cushion materials 17 are interposed between the facing portion 14 and the supported portion 22 of the blade metal plate 21 of Example 1, vibration generated at the supported portion 22 is absorbed by the elastic deformation of the cushion materials 17 and is damped. As a result, noise is reduced.

Here, in the structure in the related art disclosed in JP-A-2003-84637 ([0028], [0031] to [0041], [0046], [0047], and FIGS. 1 and 2) and JP-A-2009-294355 ([0027] to [0031], [0039], [0046], [0052] to [0059], FIGS. 1 and 4, and FIGS. 7 to 11), damping members are disposed on a frame body of a cleaning member at positions different from a position where a blade metal plate is supported by a screw, a rotating shaft, or the like. Further, the damping members are also provided at two positions, that is, at end portions of the blade metal plate in the longitudinal direction of the blade metal plate. Here, since the damping members are supported while being contracted so as to damp vibration, an elastic restoring force is applied and the blade metal plate is pushed when vibration is not generated. Accordingly, bending is apt to occur at two positions in the longitudinal direction that are positions where the damping members are provided on the blade metal plate. If bending occurs at the blade metal plate, there has been a concern that bending also occurs at the cleaning blade supported by the blade metal plate. If the cleaning blade is bent, there is a concern that cleaning ability is reduced. For this reason, if portions corresponding to two positions in the longitudinal direction where bending occurs and portions corresponding to positions where bending does not occur exist, there is a problem in that cleaning ability becomes non-uniform.

On the other hand, in Example 1, the shoulder screws 31 passing through the cushion materials 17 fixedly support the supported portion 22 on the facing portion 14, and the shoulder screws 31 fix the supported portion 22 at the positions where the supported portion is pushed against the cushion materials 17 to which an elastic restoring force is applied.

Accordingly, in the cleaner CL1 of Example 1, the occurrence of the bending of the cleaning blade 2 is reduced by the suppression of the bending of the blade metal plate 21 as compared to the related art where there is a concern that cleaning ability is reduced since the blade metal plate is bent by being pushed against the damping members. Therefore, in the cleaner CL1 of Example 1 where the bending of the cleaning blade 2 is reduced, the reduction of the cleaning ability for removing residual toner and the poor cleaning of the photoconductor PR caused by the reduction of the cleaning ability are suppressed, so that the deterioration of image quality is suppressed.

Further, since the supported portion 22 is supported with a preset gap between the facing portion 14 and itself, the cushion materials 17 are interposed between the facing portion 14 and the supported portion 22 while being contracted therebetween. Here, if the supported portion 22 and the facing portion 14 are fixed to each other by screws without stepped portions 33, time and effort are required to set a gap between the facing portion and the supported portion to a preset gap and the structure of the cleaner also becomes complicated. For this reason, there is a concern that flaws occur for every solid to be produced.

On the other hand, in Example 1, the screw portions 34 are fixed to the screw holes 14*a* while the lower ends of the heads 32 come into contact with the upper surface of the supported portion 22 and the lower ends of the stepped portions 33 come into contact with the upper surface of the facing portion 14. Further, the shoulder screws 31 fix the supported portion 22 to the facing portion 14 while the gap between the supported portion 22 and the facing portion 14 is set to the gap of the stepped portion 33. Accordingly, it may be possible to set the gap between the supported portion 22 and the facing portion 14 to the length of the stepped portion 33 by merely fastening the shoulder screws 31, so that the length of the contracted cushion material 17 is set.

Therefore, in the cleaner CL1 of Example 1, it is easy to fixedly support the supported portion 22 on the facing portion 14 while a preset gap is formed between the supported portion 22 and the facing portion 14 as compared to the structure where the shoulder screws 31 having the stepped portions 33 are not used. As a result, it may be possible to easily set the amount of elastic deformation of the cushion material 17 or an elastic force to a preset amount or the like.

Further, as shown in FIG. 2, the cushion material 17 of Example 1 is elastically deformed so as to have an L shaped cross-section while being interposed between the supported portion 22 and the facing portion 14. Accordingly, not only the right portion 17*b* of the upper surface of the cushion material 17 but also the left portion 17*c* thereof comes into contact with the supported portion 22.

Therefore, it may be possible to damp vibration not only in the up-and-down direction where the supported portion 22 approaches and is separated from the facing portion 14 but also in a slide direction where the supported portion 22 is deviated from the facing portion 14 in the left-and-right direction.

Particularly, in Example 1, when vibration is generated at the cleaning blade 2, the blade metal plate 21 vibrates so as to be rotated about a portion of the blade metal plate 21, which is supported by the cleaning container main body 4 and is close to the second fastening screw 26. That is, the left end of the supported portion 22 vibrates in the lower left direction and the upper right direction. Here, as compared to a case where the left portion 17*c* of the upper surface of the cushion material 17 does not exist and the supported portion 22 is pushed by only the right portion 17*b* of the upper surface thereof, the supported portion is pushed by both the left and right portions 17*c* and 17*b* of the upper surface of the cushion material in Example 1. Accordingly, it may be possible to efficiently damp the vibration of the cleaning blade 2.

Further, in a case where the vibration of the blade metal plate 21 is to be suppressed, vibration damping efficiency when the vibration is suppressed at a position distant from the second fastening screw 26 that is the center of vibration is higher than that when the vibration is suppressed at a position close to the second fastening screw 26. However, since the cushion material 17 is pushed by the left side surface 37 most distant from the second fastening screw 26 in Example 1, it may be possible to efficiently damp vibration.

Moreover, the facing portion 14 of Example 1 is made of the same material as the material of the supported portion 22, and the thickness of the facing portion 14 in the up-and-down direction is smaller than that of the supported portion 22 in the up-and-down direction. Accordingly, the stiffness of the facing portion 14 is lower than that of the supported portion 22. Therefore, the facing portion 14 is easily bent as compared to the supported portion 22. For this reason, the facing portion 14 is easily curved as compared to the supported portion 22 while the elastic forces of the cushion materials 17 are applied. As a result, the generation of the curvature of the supported portion 22 is reduced, so that the occurrence of the bending of the supported portion 22 is reduced.

Accordingly, as compared to a case where the stiffness of the facing portion 14 is higher than or equal to that of the supported portion 22, the bending of the supported portion 22 is suppressed in the cleaner CL1 of Example 1. Therefore, the occurrence of the bending of the cleaning blade 2 is reduced.

Further, when the fixing metal plate 11 is fixed to the sheet-metal fixing section 6, the sheet-metal fixing section is pushed against the first fastening screws 16, so that the deformation of the sheet-metal fixing section is generated. The deformation of the sheet-metal fixing section is absorbed by the fixing metal plate 11, so that the occurrence of the bending of the supported portion 22 is reduced.

The fixing metal plate 11 of Example 1 is bent in the shape of a crank, and the fixed section 12 and the facing portion 14 are connected in the shape of a step by the connecting portion 13.

Accordingly, since the structural stiffness of the crank-shaped fixing metal plate 11 is higher than that of the flat plate-like fixing metal plate, it is suppressed that the facing portion 14 is curved by being pushed by the cushion materials 17 and wavy uneven undulation is generated at the facing portion 14.

Further, since undulation is apt to be absorbed by the connecting portion 13 as compared to the flat plate-like fixing metal plate even though undulation is generated on the facing portion 14, undulation is hardly generated at the fixed section 12.

Accordingly, an adverse effect such as distortion, which is caused by the elastic forces of the cushion materials 17, on the fixing metal plate 11 or the sheet-metal fixing section 6 is suppressed.

(Modifications)

The example of the invention has been described in detail above, but the invention is not limited thereto. The various modifications of the invention can be made within the scope of the invention set forth in claims. Modifications (H01) to (H08) of the invention will be exemplified below.

(H01) Although the image forming apparatus U has been exemplified in the above-mentioned example, the invention is not limited thereto and may also be applied to a copying machine, a facsimile, a complex machine having plural functions thereof, or the like. Further, the invention is not limited to a one-colored image forming apparatus, that is, a so-called monochrome image forming apparatus, and may be applied to a polychrome image forming apparatus, that is, a so-called color image forming apparatus.

(H02) Although the configuration in which the cleaner CL1 serving as an example of a cleaning unit cleans the surface of the photoconductor PR has been exemplified in the above-mentioned example, the invention is not limited thereto and may also be applied to a unit for cleaning the transfer roller TR or a unit for cleaning the charging roller CR. In addition, the invention may also be applied to a unit for cleaning a belt-shaped or drum-shaped intermediate transfer body in a color image forming apparatus.

(H03) Although the configuration in which the facing portion 14 and the supported portion 22 are fixed to each other by three shoulder screws 31 has been exemplified in the above-mentioned example, the invention is not limited thereto. The facing portion 14 and the supported portion 22 may be fixed to each other by two or less shoulder screws 31 or four or more shoulder screws 31. That is, the number of the shoulder screws may be arbitrarily changed according to design or specification.

(H04) Although the configuration in which three cushion materials 17 serving as an example of the damping members are disposed has been exemplified in the above-mentioned example, the invention is not limited thereto. Two or less cushion materials 17 or four or more cushion materials 17 may be disposed, and the number of the cushion materials 17 may be arbitrarily changed according to design or specification. Further, cushion materials without the cushion openings 18 may be disposed instead of the cushion materials 17 exemplified in Example 1 at positions adjacent to the screw holes 14*a* of the facing portion 14 and the shoulder screws 31 fix the supported portion 22 to the facing portion 14 while being closed to the disposed cushion materials; and there may be provided cushion materials that are formed so as to have an L shaped cross-section and come into contact with the lower surface contact portion 36 and the left side surface 37 while being interposed between the facing portion 14 and the supported portion 22. That is, the shape of the cushion material may be arbitrarily changed according to design or specification. Further, it is preferable that the cushion material 17 interposed between the supported portion 22 and the facing portion 14 exemplified in Example 1 come into contact with the left side surface 37 and the lower surface contact portion 36 of the supported portion 22. However, the cushion material 17 may come into contact with one surface, that is, the lower surface contact portion 36 without coming into contact with the left side surface 37 to damp the vibration of the cleaning blade 2.

(H05) Although the configuration in which the facing portion 14 and the supported portion 22 are fixed to each other by the shoulder screw 31 having the stepped portion 33 serving as an example of a fixing member is preferable in the above-mentioned example, the invention is not limited thereto. For example, the facing portion 14 and the supported portion 22 may be fixed to each other by fixing members that do not have stepped portions 33.

(H06) Although the configuration in which the facing portion 14 is made of the same metal material as the material of the supported portion 22 and is formed to be thin has been exemplified in the above-mentioned example, the invention is not limited thereto. For example, the facing portion 14 and the supported portion 22 may not be made of the same metal material and the facing portion 14 may be made of a material having stiffness lower than the stiffness of the supported portion 22. In this case, the facing portion 14 may be made of a material having low stiffness, may be formed to have a thickness equal to or larger than the thickness of the supported portion, and may be formed to have stiffness lower than the stiffness of the supported portion 22. Further, it is preferable that the stiffness of the facing portion 14 be lower than that of the supported portion 22. However, the stiffness of the facing portion 14 may be equal to or higher than the stiffness of the supported portion 22. For example, the same material as the material of the supported portion 22 may be used to form the facing portion 14 and the thickness of the facing portion 14 may be equal to or larger than that of the supported portion 22. Alternatively, a material having stiffness higher than the stiffness of the supported portion 22 may be used to form the facing portion 14 so that the stiffness of the facing portion 14 is higher than that of the supported portion 22. Further, a material having stiffness lower than the stiffness of the supported portion 22 may be used to form the facing portion 14 and the facing portion 14 is formed so as to have a thickness larger than the thickness of the supported portion 22, so that the stiffness of the facing portion 14 may be equal to or higher than that of the supported portion 22.

(H07) Although the shape of the fixing metal plate 11, which serves as an example of a supporting portion of a support, bent in the shape of a crank is preferable in the above-mentioned example, the invention is not limited thereto. For example, a supporting portion of a flat plate-like support may also be used and the material or shape of the supporting-portion-of-support may be arbitrarily changed according to design or use.

(H08) Although the configuration of the cleaning container 1 where the cleaning container main body 4 and the sheet-metal fixing section 6 are separately formed has been exemplified in the above-mentioned example, the invention is not limited thereto and the cleaning container main body 4 may be formed integrally with the sheet-metal fixing section 6.

The foregoing description of the exemplary embodiments of the invention has been provided for the purpose of illustration and description. It is not intended to be exhaustive or to limit the invention to the precise forms disclosed. Obviously, many modifications and variations will be apparent to practitioners skilled in the art. The embodiments were chosen and described in order to best exampling the principles of the invention and its practical applications, thereby enabling others skilled in the art to understand the invention for various embodiments and with the various modifications as are suited to the particular use contemplated. It is intended that the scope of the invention is defined by the following claims and their equivalents.

What is claimed is:

1. A cleaning unit comprising:

a cleaning member that is formed in the shape of a plate having an end portion coming into contact with a surface of an image carrier, and cleans the surface of the image carrier;

a cleaning container that stores developer removed by the cleaning member;

a cleaning support that is formed by bending a plate and includes a cleaning-supporting portion supporting the other end portion of the cleaning member and a supported portion angled with respect to the cleaning-supporting portion by bending;

a supporting-portion-of-support that includes a facing portion facing the supported portion, is provided at the cleaning container, and supports the cleaning support;

a damping member that is disposed between the supported portion and the facing portion, is formed so as to be elastically deformable, and regulates vibration of the cleaning member; and a securing member that secures the cleaning support to the supporting-portion-of-support at a position adjacent to the damping member, wherein the damping member pushes the supported portion away from the facing portion, wherein the supported portion comprises a left side surface opposite from the cleaning-supporting portion and the damping member comprises a left end facing the cleaning-supporting portion and disposed farther away from the cleaning-supporting portion than a right end of the damping member, and wherein the left side surface of the supported portion is disposed between the left and right end of the damping member.

2. The cleaning unit according to claim 1, wherein the supported portion is provided with a first opening;

the facing portion is provided with a second opening that is formed at a position corresponding to the first opening; and the securing member includes one end portion engaged with the first opening, the other end portion engaged with the second opening, and a stepped portion disposed between the one end portion and the other end portion and having a diameter that is smaller than a diameter of one of the first opening and the second opening, which is larger than the other, and is larger than a diameter of the other of the first opening and the second opening, which is smaller than the other, the securing member securing the cleaning support to the supporting-portion-of-support with a preset gap while one end of the stepped portion comes into contact with an edge of the other and the damping member is compressed according to the length of the stepped portion in a direction where the one end and the other end of the stepped portion are connected to each other, when the one end portion and the other end portion are engaged with the first opening and the second opening, respectively.

3. The cleaning unit according to claim 1, wherein the supporting-portion-of-support includes the facing portion, a first portion that is formed by bending the supporting portion at an end portion of the facing portion, and a second portion that is formed by bending the supporting portion at an end portion of the first bent portion opposite to the end portion of the facing portion.

4. The cleaning unit according to claim 1, wherein the stiffness of the facing portion is lower than the stiffness of the supported portion.

5. A cleaning unit comprising:

a cleaning member that is formed in the shape of a plate having an end portion coming into contact with a surface of an image carrier, and cleans the surface of the image carrier;

a cleaning container that stores developer removed by the cleaning member;

a cleaning support that is formed by bending a plate and includes a cleaning-supporting portion supporting the other end portion of the cleaning member and a supported portion angled with respect to the cleaning-supporting portion by bending;

a supporting-portion-of-support that includes a facing portion facing the supported portion, is provided at the cleaning container, and supports the cleaning support;

a damping member that is disposed between the supported portion and the facing portion, is formed so as to be elastically deformable, and regulates vibration of the cleaning member; and a securing member that secures the cleaning support to the supporting-portion-of-support at a position adjacent to the damping member, wherein the damping member includes a first contact portion that comes into contact with a surface of the supported portion facing the facing portion, and a second contact portion that comes into contact with a surface of the supported portion that is opposite to the cleaning-supporting portion.

6. An image carrier unit comprising:

an image carrier that carries an image formed on a surface thereof with developer; and a cleaning unit that cleans the surface of the image carrier by removing the developer adhering to the surface of the image carrier, the cleaning unit comprising:

a cleaning member that is formed in the shape of a plate having an end portion coming into contact with the surface of the image carrier, and cleans the surface of the image carrier;

a cleaning container that stores developer removed by the cleaning member;

a cleaning support that is formed by bending a plate and includes a cleaning-supporting portion supporting the other end portion of the cleaning member and a supported portion angled with respect to the cleaning-supporting portion by bending;

a supporting-portion-of-support that includes a facing portion facing the supported portion, is provided at the cleaning container, and supports the cleaning support;

a damping member that is disposed between the supported portion and the facing portion, is formed so as to be elastically deformable, and regulates vibration of the cleaning member; and a securing member that secures the cleaning support to the supporting-portion-of-support at a position adjacent to the damping member, wherein the damping member pushes the supported portion away from the facing portion, wherein the support portion comprises a left side surface opposite from the cleaning-supporting portion and the damping member comprises a left end facing the cleaning-supporting portion and disposed farther away from the cleaning-supporting portion than a right end of the damping member, and wherein the left side surface of the support portion is disposed between the left and right end of the damping member.

7. An image forming apparatus comprising:

an image carrier that is rotated;

a charger that charges a surface of the image carrier;

a latent image writing unit that writes a latent image on the image carrier;

a developing unit that develops the latent image, which is formed on the surface of the image carrier, into a visible image;

a transfer unit that transfers the visible image, which is formed on the surface of the image carrier, to a body to which an image is to be transferred; and a cleaning unit that cleans the surface of the image carrier by removing the developer adhering to the surface of the image carrier after transfer, the cleaning unit comprising:

a cleaning member that is formed in the shape of a plate having an end portion coming into contact with the surface of the image carrier, and cleans the surface of the image carrier;

a cleaning container that stores developer removed by the cleaning member;

a cleaning support that is formed by bending a plate and includes a cleaning-supporting portion supporting the other end portion of the cleaning member and a supported portion angled with respect to the cleaning-supporting portion by bending;

a supporting-portion-of-support that includes a facing portion facing the supported portion, is provided at the cleaning container, and supports the cleaning support;

a damping member that is disposed between the supported portion and the facing portion, is formed so as to be elastically deformable, and regulates vibration of the cleaning member; and a securing member that secures the cleaning support to the supporting-portion-of-support at a position adjacent to the damping member, wherein the damping member pushes the supported portion away from the facing portion, wherein the support portion comprises a left side surface opposite from the cleaning-supporting portion and the damping member comprises a left end facing the cleaning-supporting portion and disposed farther away from the cleaning-supporting portion than a right end of the damping member, and wherein the left side surface of the support portion is disposed between the left and right end of the damping member.

* * * * *